US010329703B2

(12) United States Patent
Bergamo

(10) Patent No.: US 10,329,703 B2
(45) **Date of Patent: *Jun. 25, 2019**

(54) DETECTION SYSTEM OF WASHING MACHINES REMOVABLE BASKET AND METHOD FOR DETECTION OF WASHING MACHINES REMOVABLE BASKET

(71) Applicant: WHIRLPOOL S.A., Sao Paulo (BR)

(72) Inventor: Danilo Antonio Bergamo, Batatais (BR)

(73) Assignee: Whirlpool S.A., Sao Paulo (BR)

( * ) Notice: Subject to any disclaimer, the term of this patent is extended or adjusted under 35 U.S.C. 154(b) by 0 days.

This patent is subject to a terminal disclaimer.

(21) Appl. No.: 15/699,398

(22) Filed: Sep. 8, 2017

(65) Prior Publication Data

US 2017/0370042 A1 Dec. 28, 2017

Related U.S. Application Data

(63) Continuation of application No. 14/786,659, filed as application No. PCT/BR2014/000324 on Sep. 9, 2014, now Pat. No. 9,777,419.

(30) Foreign Application Priority Data

Oct. 1, 2013 (BR) ..... 1020130253430

(51) Int. Cl.

| | |
|---|---|
| ***D06F 39/00*** | (2006.01) |
| ***D06F 37/12*** | (2006.01) |
| ***D06F 37/16*** | (2006.01) |
| *D06F 29/00* | (2006.01) |
| *D06F 31/00* | (2006.01) |

(52) U.S. Cl.
CPC ..... *D06F 37/12* (2013.01); *D06F 37/16* (2013.01); *D06F 39/002* (2013.01); *D06F 29/00* (2013.01); *D06F 31/00* (2013.01)

(58) Field of Classification Search
CPC ..... D06F 39/002
See application file for complete search history.

(56) References Cited

U.S. PATENT DOCUMENTS

| | | | |
|---|---|---|---|
| 2,748,788 | A | 6/1956 | Duckstein |
| 3,014,358 | A | 12/1961 | Bochan |
| 3,029,623 | A | 4/1962 | Morey |
| 3,209,560 | A | 10/1965 | Shelton |
| 3,481,162 | A | 12/1969 | Ziegler |
| 3,509,741 | A | 5/1970 | Morey |

(Continued)

FOREIGN PATENT DOCUMENTS

| | | |
|---|---|---|
| BR | DI7003246-7 | 10/2011 |
| BR | 102013015674 A2 | 7/2015 |

(Continued)

OTHER PUBLICATIONS

International Search Report and the Written Opinion of the International Search Authority for International Application No. PCT/BR2014/000324 dated Oct. 30, 2014.

*Primary Examiner* — Jason Y Ko
(74) *Attorney, Agent, or Firm* — McGarry Bair PC

(57) ABSTRACT

The present invention relates to a washing machine having at least one washing basket defining a first treating chamber and at least one removable washing basket that is selectively receivable within the first treating chamber as well as at least one sensor and at least one component able to cause excitation in the sensor.

10 Claims, 2 Drawing Sheets

(56) References Cited

U.S. PATENT DOCUMENTS

| | | | |
|---|---|---|---|
| 3,575,020 | A | 4/1971 | Hubbard |
| 4,118,957 | A | 10/1978 | Marcussen |
| 4,175,409 | A | 11/1979 | Morey |
| 4,186,573 | A | 2/1980 | Brenner |
| 4,225,992 | A | 10/1980 | Morey |
| 4,637,230 | A | 1/1987 | Roberts |
| 4,637,231 | A | 1/1987 | McMillan |
| 5,497,638 | A | 3/1996 | Berkan et al. |
| 7,401,479 | B2 | 7/2008 | Fields |
| 7,866,191 | B2 | 1/2011 | Turner |
| 9,404,213 | B2 | 8/2016 | Kappler |
| 2007/0084254 | A1 | 4/2007 | Messina |
| 2009/0211108 | A1 | 8/2009 | Nehring |
| 2011/0094902 | A1 | 4/2011 | Delehey |
| 2015/0059417 | A1 | 3/2015 | Ramasco |
| 2015/0184326 | A1 | 7/2015 | Pyo |
| 2015/0211163 | A1 | 7/2015 | Jeon |
| 2016/0201243 | A1 | 7/2016 | Bergamo |
| 2016/0222567 | A1 | 8/2016 | Manz |

FOREIGN PATENT DOCUMENTS

| | | | |
|---|---|---|---|
| BR | 102013018364 | A2 | 8/2015 |
| BR | 102013021866 | A2 | 8/2015 |
| BR | 102013015672 | A2 | 9/2015 |
| BR | 102013027400 | A2 | 9/2015 |
| BR | 102013025343 | A2 | 11/2015 |
| BR | 102014008903 | A2 | 12/2015 |
| BR | 102014010905 | A2 | 12/2015 |
| BR | 102014010908 | A2 | 12/2015 |
| BR | 102014018397 | A2 | 2/2016 |
| CN | 203530690 | U | 4/2014 |
| CN | 203729101 | U | 7/2014 |
| CN | 105220395 | A | 1/2016 |
| WO | 2013088426 | A2 | 6/2013 |
| WO | 2015048870 | A1 | 4/2015 |

DETECTION SYSTEM OF WASHING MACHINES REMOVABLE BASKET AND METHOD FOR DETECTION OF WASHING MACHINES REMOVABLE BASKET

CROSS-REFERENCE TO RELATED APPLICATIONS

This application is a continuation of U.S. patent application Ser. No. 14/786,659, filed Oct. 23, 2015, now U.S. Pat. No. 9,777,419, issued Oct. 3, 2017, which is a U.S. National Phase of International Application No. PCT/BR2014/000324, filed Sep. 9, 2014, which claims priority to Brazilian Patent Application No. BR 10 2013 025343 0, filed on Oct. 1, 2013, all of which are incorporated herein by reference in their entirety.

FIELD OF THE INVENTION

The present invention relates to a detection system of washing basket and more particularly to washing machines consisting of attached washing basket and a modular and removable washing basket. The subject invention further relates to a method for detecting washing machines removable basket, which is particularly suitable for the detection system of washing machines removable basket now disclosed.

Together, the system and method disclosed herein allow an automatic, complementary or independent verification from the verification by the user, which allows determining if a removable basket is or not coupled to the stirrer of a washing machine capable of this type of coupling.

BACKGROUND

As is known to those skilled technicians in the art, washing machines and in particular clothes washing machines comprise machines for washing articles in general in an aqueous medium. Thus, it is evident to note that clothes washing machines comprise, among other functional components and elements, at least one washing basket.

Conventionally, a washing basket of a clothes washing machine defines an environment able to pack an aqueous medium (water and cleaning supplies) and a specific load of articles to be washed.

Also conventionally, a washing basket of a clothes washing machine provides means for mechanical association to a motive source (usually an electric motor) existing in the washing machine. Such means of mechanical association are responsible for transmitting the rotary motion of the motor to said washing basket. Different stages of the washing process require this movement of the washing basket.

Conventionally, a clothes washing machine comprises only one washing basket, that is, only an environment able to receive an aqueous medium and a load of articles to be washed.

In these cases, it is necessary to perform a kind of screening of the articles that will compose a washing load, that is, it is necessary for example to separate the white clothes from the colored ones so that they do not smear each other during the washing process.

This type of screening implies the need of conducting at least two complete washing processes. In the present example, at least one washing process for the white clothes and at least one washing process for colored ones.

The current state of the art provides the possibility of using removable baskets together with attached baskets in clothes washing machines.

An example of this kind of concept can be found in document U.S. Pat. No. 3,014,358, where it is described a clothes washing machine which provides, in addition to the main washing basket, a removable washing basket liable of attachment in the stirrer of the washing machine, which is arranged inside the main washing basket. In this example, both washing baskets have fluid communication with each other, that is, the same aqueous medium used in the main washing basket is used in the removable washing basket.

Another example of the same concept is disclosed in document U.S. Pat. No. 7,401,479, wherein the use of a removable washing basket liable of attachment to the bottom of a main washing basket is described. In this example, the two washing baskets also have fluid communication with each other, with the same aqueous medium being used for both baskets.

In both examples above, as well as other embodiments based on this same concept, there is, for practical purposes, no difference between using or not using the removable washing basket, after all, it is understood that the washing machine is liable of conventional operating with or without said removable washing basket.

This occurs mainly by the fact that both the main washing basket and the removable washing basket operate in a same aqueous medium. Therefore, systems for filling and draining the washing machine operate in a standard and independent manner from the use or not of the removable washing basket.

Moreover, the current state of the art also includes a second concept substantially different from the concept illustrated in documents U.S. Pat. Nos. 3,014,358 and 7,401,479.

In this second concept, a clothes washing machine also provides for the existence of two washing baskets, one main and attached and one modular and removable. However, in this second concept, the washing baskets do not present fluid communication with each other (at least not during the washing process) and depending on this, each washing baskets operate as own aqueous media and distinct from one another.

An example of this second concept can be found in document U.S. Pat. No. 3,575,020, wherein it is described a washing machine consisting of a storage tank of water and, within this, an attached washing basket and a removable washing basket.

In general, the removable washing basket is able to be attached to the upper end of the stirrer which is disposed inside the attached washing basket. It is also worth noting that the aforementioned removable washing basket still has water drainage holes facing the inside of the attached washing basket.

Anyway, during the washing process, the attached washing basket receives a first aqueous medium and a first washing load, while the removable washing basket receives a second aqueous medium and a second washing load. Obviously, said removable washing basket cannot be used and, in this context, the clothes washing machine receives only one aqueous medium and only one washing load.

Considering this second concept, it is within the knowledge of the versed technician that the user must insert or remove the removable washing basket and hence the user must "inform" the clothes washing machine if said removable washing basket is in conditions of use or not.

Unlike the first concept (where the washing baskets present fluid communication), the use or not of the removable washing basket alters all the functional dynamics of the washing machine, after all, two distinct filling steps and two distinct draining steps are required, in addition to other intermediate steps which guarantee the independent operation of both baskets.

Thus, it is extremely important to identify, preferably before the start of the washing process, if the removable washing basket is in conditions of use or not, and it is based on this premise that the present invention arises.

OBJECTIVES OF THE INVENTION

Thus, it is an objective of this invention to provide a detection system of removable basket of washing machine able to verify, independently, if a removable washing basket is in conditions of use or not. From this verification, the clothes washing machine, according to the subject invention, may take appropriate pre program mediation.

It is also an objective of the subject invention that said detection system of washing machines removable basket presents a simplistic and simultaneously robust constructiveness. In this context, the simplicity aims to avoid increasing the manufacturing costs of the washing machine, and the robustness aims to avoid failures and misuse of the washing machine.

It is another objective of the present invention to propose a method for detecting washing machines removable basket, which is especially suited to the detection system of washing machines removable basket now disclosed and its main objective is to verify the existence or not of the removable washing basket before the beginning of the washing process.

SUMMARY

An aspects of the present disclosure relates to a washing machine, comprising, a structure defining an interior of the washing machine, a first washing basket located within the interior of the washing machine and defining a first treating chamber, a second washing basket defining a second treating chamber and where the second washing basket is removable and configured to be selectively received within the first treating chamber, at least one sensor located within the interior of the washing machine or located on the second washing basket and at least one component configured to cause excitation of the at least one sensor and where the at least one component is located on the other of the interior of the washing machine or the second washing basket, wherein the sensor is configured to provide an output based on the excitation that is indicative of a presence of the second washing basket.

Another aspect of the present disclosure relates to a method for operating a washing machine having a first washing basket having a first open top and defining a first treating chamber for receiving laundry, the method comprising receiving, from a sensor, an output indicative of a presence or an absence of a removable second washing basket within the first treating chamber, identifying, by a controller, the presence or the absence of the removable second washing basket based on the received sensor output, and operating the washing machine based on the identifying of the presence or the absence of the removable second washing basket.

BRIEF DESCRIPTION OF THE DRAWINGS

The present invention will be detailed based on the figures listed below, which.

DETAILED DESCRIPTION

Figure 1:
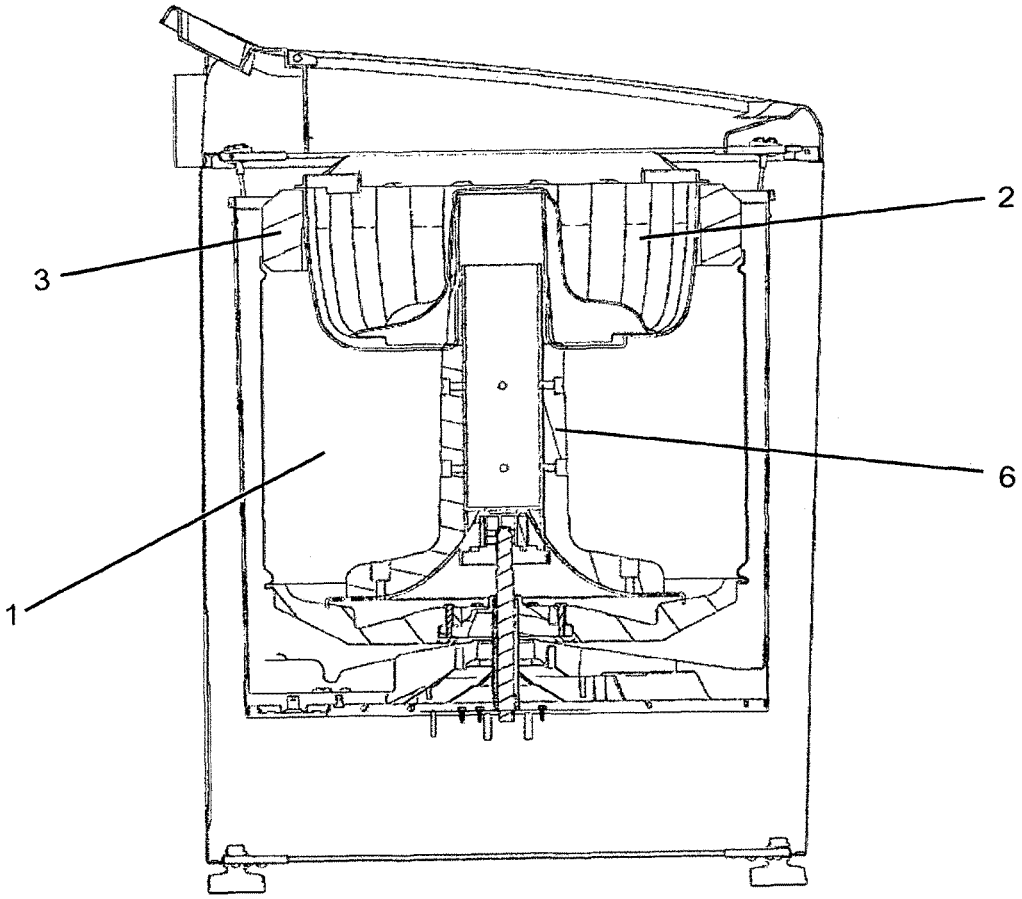
FIG. 1 illustrates in schematic section a washing machine fundamentally based on the second concept (two washing tanks, one attached and the other removable, free of fluid communication with each other) previously detailed.

As previously mentioned, it is within the knowledge of the technicians skilled in the art that washing machines can take an embodiment as illustrated in FIG. 1.

In FIG. 1, it is illustrated in schematic section a washing machine mainly composed of a structural set defined by an outer case and a movable lid which provides access to the interior of said outer case.

Inside the outer case, it is provided one washing basket 1 that, attached to the washing machine, is susceptible to rotational movement inherent to the steps of the washing process. The washing basket 1, in its different possibilities of configuration and/or embodiment, is notorious to the technicians versed in the subject matter.

Inside said washing basket 1, it is arranged a stirrer, which is essentially composed by a base and a column. The current state of the art provides for a wide range of configurations and/or embodiments of stirrers, and thus the stirrer is also evident to the technicians skilled in the art.

In general, both the washing basket 1 and the stirrer are functionally connected to a rotating mechanism (not shown) capable of transmitting rotation to these two components. This aspect is also within the knowledge of the technicians skilled in the subject matter.

Inside the washing basket 1, it is provided for the existence of a washing basket 2 that, removable from the washing machine, is capable of rotational movement (inherent to the steps of the washing process) through a motive source 6.

According to the mentioned FIG. 1, the motive source 6 of the washing basket 2 is the column of the stirrer existing inside the washing basket 1. However the motive source 6 of the washing basket 2 may comprise any set capable to transmit the rotational movement of the rotational mechanism (not shown) to said washing basket 2.

The existence of a washing basket 2 removable from the washing machine and arranged within the washing basket 1 attached to the washing machine is also already described in documents belonging to the current state of the art. More particularly, the aforementioned document U.S. Pat. No. 3,575,020 already describes the use of a removable washing basket liable of coupling to the upper end of the column of the washing machine stirrer.

Still according to FIG. 1, it is also noted that the washing machine comprises at least one structural component 3 attached to the washing machine. Such a structural component can comprise from one collector ring of washing inputs up to a connection element of between two or more internal components that make up the washing machine.

Thus, it is important to note that, according to the subject invention, the attached structural component 3 can comprise any component/part/element that, being located inside the washing machine, does not present any kind of movement (except eventual vibrating movements inherent to the conventional operation of the washing machine).

According to the present invention, said structural component 3 is an attached annular structure arranged (and free of physical contact) on the washing basket 1.

All the features and descriptions explained above comprise the current state of the art.

The major inventive aspect of the subject invention mainly consists of allocating a sensor 4 in said structural component 3 and, in addition, allocating a component 5 (able to cause excitation in sensor 4) in the washing basket.

Optionally, the scheme of "allocation" could be otherwise. The sensor (4) could be allocated in the washing basket 2 and the component 5 (able to cause excitation in sensor 4) could be allocated in the structural component 3.

With the addition of these two components, the main objective of the subject invention—provide a simplified system capable of detecting the presence of the washing basket 2 inside the washing basket 1—is fully achieved.

Figure 2:
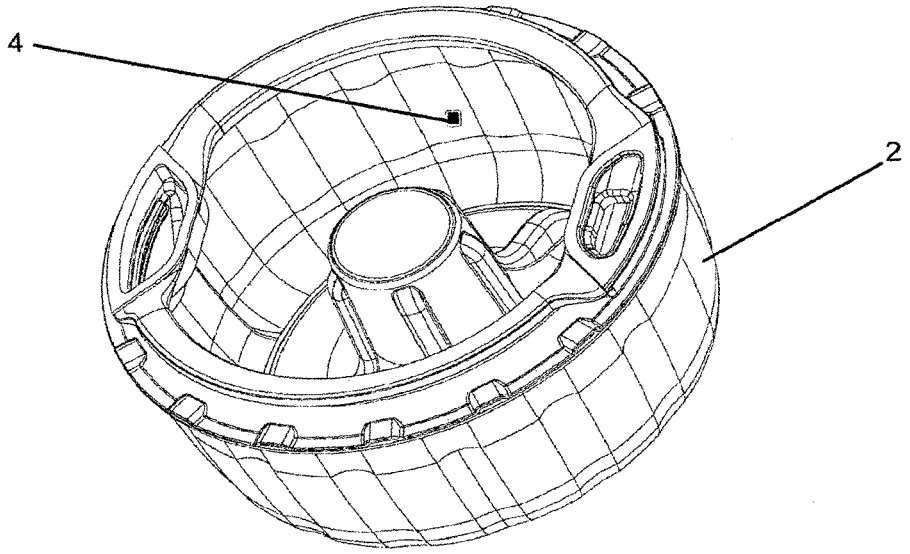
FIG. 2 illustrates in schematic prospective the detection system of washing machines removable basket according to the present invention.
Figure 3:
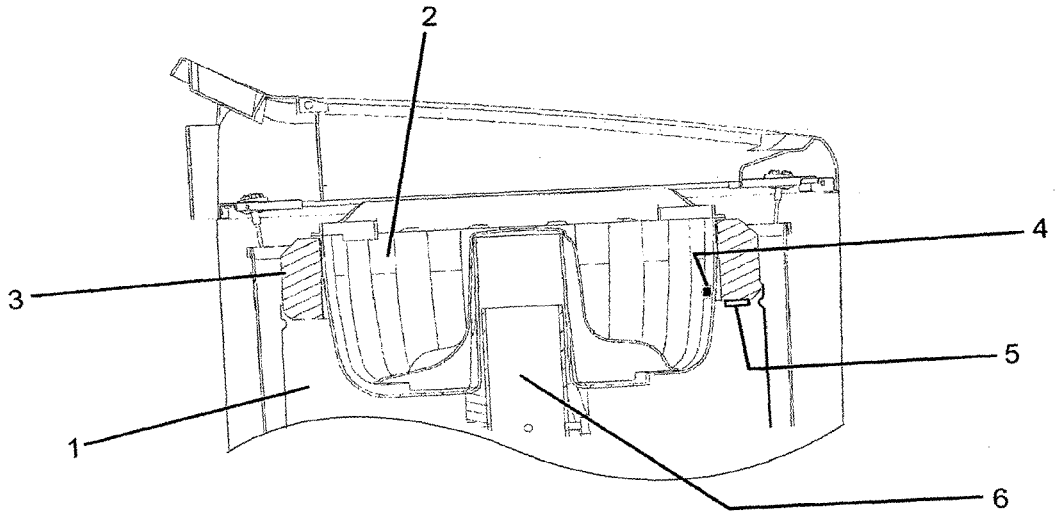
FIG. 3 illustrates in schematic top view the detection system of washing machines removable basket according to the present invention.

According to the preferred embodiment of the subject invention, as illustrated in FIGS. 2 and 3, the sensor 4 is, in fact, arranged in an attached manner along the structural component 3, while the component 5 (able to cause excitation in the sensor 4) is, in fact, disposed on the top edge of the washing basket 2.

Preferably, the sensor 4 and the component 5 (able to cause excitation in the sensor 4) are horizontally aligned.

In this preferred embodiment, the sensor 4 comprises an inductive sensor able to generate an output signal relatively variable to the accuracy of electromagnetic fields.

However, the sensor 4 may also comprise a magnetic or electromagnetic sensor.

Still in this preferred embodiment, the component 5 (able to cause excitation in the sensor 4) comprises a magnet of fixed magnetic field, which can even be injected together with the thermosetting material of the washing basket 2.

However, the component 5 (able to cause excitation in the sensor 4) could comprise an electromagnet (although this embodiment is difficult to achieve, after all, the electromagnet feeding would have to be able to work together with the movement of the washing basket 2).

Anyway, the main idea is that the component 5 (able to cause excitation in the sensor 4), when approaching the sensor 4, change the output signal of the latter, and that this change of the output signal of the sensor 4 is used (by a mechanical, electromechanical or electronic system) to detect the presence of the washing basket 2. Obviously, the non-changing of the output signal of the sensor 4 comprises, however, an indication that the washing basket 2 is not coupled the upper end of the stirrer.

Considering this fundamental concept of the detection system of washing machines removable basket disclosed herein, it can be considered feasible the possible use of a sensor set 4+component 5 based on optical interaction (as opposed to magnetic interaction).

This means that the present system is functional if the sensor 4 comprises optical sensor 4 and the component 5 comprises a generating or refracting source of light.

The present invention further provides a method for detecting washing machines removable basket, which is particularly suitable to the detection system of washing machines removable basket detailed above.

In general, the subject method has the premise of forcing the approaching of the component 5 to the sensor 4, if the washing basket 2 is coupled to the upper end of the stirrer. With this, it is intended to eliminate a possible "false negative" diagnosis that might occur if said washing basket 2 is properly attached to the washing machine, but with the component 5 away from the sensor 4.

Accordingly, the subject method is to activate the motive source 6 (that in the preferred embodiment of the system is the stirrer itself, which is rotated from an electric motor) of the washing basket 2 by at least one mechanical turn, so that the entire circumference of the washing basket 2 is approximated to the sensor 4.

Thus, it is guaranteed that, if the washing basket 2 is in conditions of use, the component 5 will approach to the sensor 4 in order to change its output signal.

Thus, it is guaranteed that the change of the output signal of the sensor 4, along a mechanical turn of the motive source 6, indicates that the washing basket 2 is not coupled to the washing machine.

On the other hand, the non-changing of the output signal of the sensor 4, along a mechanical turn of the motive source 6, indicates that the washing basket 2 is not coupled to the washing machine.

The above change of the output signal of the sensor 4 can be verified by microprocessor forms and systems already known, and the detection confirmation of the washing basket 2 may be triggered by a single peak of the output signal of the sensor 4 (if this sensor generates an output signal related to an electrical quantity easily measurable), or even, and the detection confirmation of the washing basket 2 may be triggered by comparing the change of the output signal of the sensor 4 and an analog parameter previously known (if this sensor generates an output signal related to an electrical quantity not easily measurable).

Also noteworthy is that the activating of the motive source 6 must preferably be performed before the initial step of the washing process (with a rotation lower than the conventional rotation) and can be stopped at the instant in that a variation in the output of the sensor is detected 4.

The mechanical and/or electromechanical and/or electronic means able to activate or deactivate the motive source 6 from various stimuli (for example, the previous detection of the washing basket 2) are widely known by those skilled in the art and does not comprise, somehow, the inventive core of the subject invention.

The same occurs with the electronic (microprocessor and/or micro controlled) means able to verify, estimate and compare the change of the output signal of the sensor 4, that is, such media are widely known by those technicians skilled on the subject and do not comprise, anyway, the inventive core of the subject invention.

Examples of the concepts of the present invention having been described and illustrated, it is to be understood that the scope thereof encompasses other possible variations, which are solely limited by the wording of the claims, including therein the possible equivalent means.

The invention claimed is:

1. A washing machine, comprising:

a structure defining an interior of the washing machine;

a first washing basket located within the interior of the washing machine and defining a first treating chamber;

a second washing basket defining a second treating chamber and where the second washing basket is removable and configured to be selectively received within the first treating chamber;

at least one sensor located within the interior of the washing machine or located on the second washing basket; and at least one component configured to cause excitation of the at least one sensor and where the at least one component is located on the other of the interior of the washing machine or the second washing basket;

wherein the sensor is configured to provide an output based on the excitation that is indicative of a presence of the second washing basket.

2. The washing machine of claim 1 wherein being located within the interior includes being operably coupled to the first washing basket.

3. The washing machine of claim 1 wherein the first washing basket further includes a ring and the at least one sensor or the at least one component is operably coupled to the ring.

4. The washing machine of claim 1, further comprising a structural component located within the interior of the washing machine.

5. The washing machine of claim 4 wherein being located within the interior includes being operably coupled to the structural component.

6. The washing machine of claim 1 wherein the sensor comprises one of a mechanical sensor, an inductive sensor, a magnetic sensor, an electromagnetic sensor, or an optical sensor.

7. The washing machine of claim 1 wherein the component comprises a magnet, an electromagnet, a light source, or a refractive element.

8. The washing machine of claim 1, further comprising a stirrer at least partially located within the first washing basket.

9. The washing machine of claim 8 wherein the second washing basket operably couples to the stirrer when the second washing basket is received within the first treating chamber.

10. The washing machine of claim 9, further comprising a controller configured to receive the output of the sensor, determine the presence of the second washing basket based on the output, and operate the washing machine based thereon.

* * * * *